US005256261A

United States Patent [19]

Lipsztajn et al.

[11] Patent Number: 5,256,261

[45] Date of Patent: Oct. 26, 1993

[54] MEMBRANE CELL OPERATION

[75] Inventors: Marek Lipsztajn, Rexdale; John Rizzi, Mississauga, both of Canada

[73] Assignee: Sterling Canada, Inc., Houston, Tex.

[21] Appl. No.: 933,108

[22] Filed: Aug. 21, 1992

[51] Int. Cl.[5] ..... C25B 1/16

[52] U.S. Cl. ..... 204/98; 204/101; 204/128

[58] Field of Search ..... 204/98, 128, 101

[56] References Cited

U.S. PATENT DOCUMENTS

| | | | |
|---|---|---|---|
| 3,884,777 | 5/1975 | Harke et al. | 204/84 |
| 3,917,521 | 11/1975 | Clarke et al. | 204/149 |
| 4,085,016 | 4/1978 | Janjua et al. | 204/104 |
| 4,191,619 | 3/1980 | Struck | 204/104 |
| 4,595,469 | 6/1986 | Foller | 204/98 |
| 4,613,416 | 9/1986 | Kau et al. | 204/98 |
| 4,773,975 | 9/1988 | Lipsztajn | 204/95 |
| 4,806,215 | 2/1989 | Twardowski | 204/98 |
| 4,849,073 | 7/1989 | Dotson et al. | 204/101 |
| 4,968,394 | 11/1990 | Dotso et al. | 204/101 |
| 4,990,228 | 2/1991 | Perusich et al. | 204/98 |
| 4,996,098 | 2/1991 | Perusich et al. | 428/229 |

FOREIGN PATENT DOCUMENTS

| | | | |
|---|---|---|---|
| 51-11098 | 1/1976 | Japan | 204/98 |
| WO91/18830 | 12/1991 | PCT Int'l Appl. . | |

*Primary Examiner*—Kathryn Gorgos
*Attorney, Agent, or Firm*—Sim & McBurney

[57] ABSTRACT

The voltage requirements of a membrane-divided cell are decreased by operating the cell with a catholyte temperature significantly in excess of the anolyte temperature, generally at least 10° C. greater and preferably at least 20° C. greater. The invention is particularly useful in an electrochemical acidification process whereby aqueous sodium chlorate and sodium sesquisulfate solution is acidified for use in a chlorine dioxide generating process and aqueous sodium hydroxide is produced as a by-product.

7 Claims, No Drawings

MEMBRANE CELL OPERATION

FIELD OF INVENTION

The present invention relates to operation of an electrochemical cell.

BACKGROUND TO THE INVENTION

In copending United States patent application Ser. No. 687,741 filed Apr. 19, 1991 (now U.S. Pat. No. 5,198,080) (E437) as a continuation-in-part of United States patent application Ser. No. 535,165 filed Jun. 8, 1990 (Now U.S. Pat. No. 5,122,240), both assigned to the assignee hereof and the disclosures of which are incorporated herein by reference, and corresponding to PCT publication No. WO 91/18830, there is described the production of an aqueous acidified chlorate ion-containing solution for use in a chlorine dioxide generating process. The process involves electrochemical acidification of an aqueous alkali metal salt solution, which preferably comprises sodium chlorate and sodium sulfate, while alkali metal ions are removed from the aqueous solution.

The process preferably is effected in an electrolytic cell comprising a cation-exchange membrane dividing the cell into an anode compartment and a cathode compartment. The aqueous alkali metal salt solution is fed to the anode compartment and alkali metal ions are removed from that compartment to the cathode compartment through the cation-exchange membrane. Hydrogen ions electrolytically-produced in the anode compartment provide acidification to the aqueous alkali metal solution.

One operational difficulty which has been encountered with respect to operation of this procedure was a relatively high cell voltage under typical conditions of operation, using an anolyte comprising about 1 M sodium sesquisulfate and 2 M sodium chlorate, a catholyte of about 5% NaOH and cell operating temperature of about 50° C. An investigation of this phenomenon indicated that the excessive cell voltage can be attributed largely to a membrane ohmic drop.

A search conducted in the facilities of the United States Patent and Trade-Mark Office with respect to the subject matter of this invention located a large variety of patents relating to electrolysis process and identified as follows:

| | | |
|---|---|---|
| 4,191,619 | 4,613,416 | 3,917,521 |
| 4,085,016 | 3,884,777 | 4,595,469 |
| 4,773,975 | 4,806,215 | 4,849,073 |
| 4,968,394 | 4,990,228 | 4,996,098 |
| WO 91/18830 | | |

However, as will become apparent from the description of the invention below, none of this prior art discloses or suggests the present invention.

SUMMARY OF INVENTION

In accordance with the present invention, the anode and cathode compartments of an ion-exchange membrane-divided cell are operated such that a significant differential in temperature exists between the anode compartment and the cathode compartment, with the catholyte being maintained at the higher temperature. By operating at such temperature differential, the cell voltage applied to the cell to achieve electrochemical acidification is decreased.

The invention has particular application to the electrochemical acidification process of the aforementioned U.S. patent application Ser. No. 687,741 but has general application to any electrolytic process in a membrane-divided cell whenever a power reduction is required.

GENERAL DESCRIPTION OF INVENTION

In operating a cell to acidify an aqueous solution of sodium chlorate and sodium sulfate, certain constraints limit actions which can be taken to overcome the membrane ohmic drop. It is known that, in the chlor/alkali cells, operation is at about 90° C. for both the anolyte and catholyte and about 30% NaOH is used as catholyte. However, increasing the anolyte temperature above about 60° C. is not practical, since the long-term stability of dimensionally stable anodes (DSA-$O_2$ ®) is impaired, while higher caustic strength in the catholyte may be unacceptable owning to the level of hardness in the aqueous solution of sodium chlorate and sodium sulfate, arising from the chlorine dioxide generator, and its effect on the membrane.

We have surprisingly found that operation of the cell with the catholyte temperature significantly exceeding the anolyte temperature significantly decreases the cell voltage requirement. In the present invention, the catholyte temperature exceeds the anolyte temperature by at least about 10° C. A significant improvement in cell voltage requirement is achieved despite the temperature limitations imposed by the anode. Further improvement can be attained using a higher sodium hydroxide concentration in the cathode compartment.

In one embodiment of the invention, the anolyte temperature is less than about 60° C., preferably about 40° to about 55° C., while the catholyte temperature exceeds that of the anolyte temperature by at least about 10° C., and may range up to about 95° C. The concentration of sodium hydroxide in the catholyte compartment may vary up to about 20 wt %, preferably about 5 to about 15 wt %.

It is surprising the degree to which the resistance of the membrane, and hence, the overall cell voltage can be decreased by the procedure of the present invention, generally at least about 5% reduction being achieved, while only a small fraction of the decrease can be attributed to a lowering of resistance of the catholyte itself, as a result of the increased temperature.

This effect of significantly decreased cell voltage is very surprising and cannot be explained simply in terms of a higher temperature of electrolysis affecting the temperature of the membrane. If such were the case, then increasing the temperature of the anolyte to 80° C. while maintaining the cathodic temperature at 60° C. also should be beneficial for cell voltage reduction. Such an effect, however, has not been observed experimentally. In fact, cell voltage reduction was observed only when the temperature of the catholyte was increased relative to the anolyte.

For a typical pulp mill generating chlorine dioxide as described in Ser. No. 687,741, annual power savings of about $30,000 can be achieved. Since hot and cold streams generally are available in a pulp mill, no energy cost should result for obtaining heat and discarding heat to maintain the desired temperature differential.

One practical solution to maintaining the temperature gradient is that the anode and/or anolyte be subjected to cooling, if required. Alternatively, the proper adjustment of the flow rates of both electrolytes can be used for this purpose.

EXAMPLE

A cation-exchange membrane-divided cell with an inter-electrode gap of 0.3 cm was operated employing a catholyte of 2N NaOH and an anolyte comprising an aqueous solution comprising 1 M of sodium sesquisulfate and 2 M of sodium chlorate. The membrane was a perfluorosulfonic acid membrane (NAFION®417). The experiments were performed, one with both anolyte and catholyte at 60° C. and the other with anolyte at 55° C. and catholyte at 80° C.

Under the latter conditions, the cell voltage was 3.76 V at a current density of 3 $kA/M^2$, representing a voltage decrease of 400 mV, based on comparison with the experiment operated at 60° C. A similar result was obtained when another perfluorosulfonic acid membrane (NAFION®430) membrane was substituted for the NAFION 417 membrane, the voltage being recorded at 3.74 V.

SUMMARY OF DISCLOSURE

In summary of this disclosure, the present invention provides a method of decreasing the voltage requirements of a membrane-divided electrolytic cell by operating the cell with the catholyte at a temperature of at least about 10° C. greater than the anolyte. Modifications are possible within the scope of this invention.

What we claim is:

1. A method of operating an electrolytic cell wherein anode and cathode compartments are separated by an ion-exchange membrane, which comprises:

decreasing the operating voltage of said cell by maintaining a catholyte in said cathode compartment at a temperature which is at least 10° C. higher than an anolyte in said anode compartment.

2. The method of claim 1 wherein said anolyte temperature is from about 40° to about 55° C.

3. The method of claim 2 wherein said catholyte temperature ranges up to about 90° C.

4. The method of claim 3 wherein said anolyte comprises an aqueous sodium salt solution, sodium ions are transferred from the anode compartment to the cathode compartment, the anolyte is acidified by the electrolysis reaction in said cell and the catholyte is alkalinated by the electrolysis reactions in said cell.

5. The method of claim 4 wherein said aqueous sodium salt solution is an aqueous solution of sodium chlorate and sodium sesquisulfate, and said catholyte is maintained at a sodium hydroxide concentration of less than about 20 wt %.

6. The method of claim 5 wherein said sodium hydroxide concentration is from about 5 to about 15 wt %.

7. The method of claim 1 wherein said catholyte is maintained at a temperature of at least 20° C. higher than the anolyte.

* * * * *